US009496078B2

(12) United States Patent
Zhang et al.

(10) Patent No.: US 9,496,078 B2
(45) Date of Patent: Nov. 15, 2016

(54) HOT ROLLED SILICON STEEL PRODUCING METHOD

(75) Inventors: Huawei Zhang, Shanghai (CN); Yaping Wu, Shanghai (CN); Yu Gong, Shanghai (CN); Yezhong Sun, Shanghai (CN); Hongxu Hei, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 293 days.

(21) Appl. No.: 14/372,689

(22) PCT Filed: Mar. 29, 2012

(86) PCT No.: PCT/CN2012/000401

§ 371 (c)(1),
(2), (4) Date: Jul. 16, 2014

(87) PCT Pub. No.: WO2013/134897

PCT Pub. Date: Sep. 19, 2013

(65) Prior Publication Data

US 2015/0243418 A1 Aug. 27, 2015

(30) Foreign Application Priority Data

Mar. 13, 2012 (CN) ..... 2012 1 0065610

(51) Int. Cl.
*C21D 6/00* (2006.01)
*H01F 1/147* (2006.01)
(Continued)

(52) U.S. Cl.
CPC ..... *H01F 1/14766* (2013.01); *C21D 1/26* (2013.01); *C21D 6/00* (2013.01); *C21D 6/008* (2013.01);
(Continued)

(58) Field of Classification Search
CPC ..... C21D 6/00; C22C 38/02; H01F 1/14766
USPC ..... 148/111
See application file for complete search history.

(56) References Cited

U.S. PATENT DOCUMENTS 4,204,891 A 5/1980 Shiozaki et al.

FOREIGN PATENT DOCUMENTS

CN 101245435 A 8/2008
CN 101607266 A 12/2009
(Continued)

OTHER PUBLICATIONS

PCT International Search Report for PCT Application No. PCT/CN2012/000401 mailed Dec. 20, 2012 (6 pages).

*Primary Examiner* — Jie Yang
(74) *Attorney, Agent, or Firm* — Sutherland Asbill & Brennan LLP

(57) ABSTRACT

A hot rolled silicon steel producing method comprises: silicon steel slab heating process, rough rolling process and finish rolling process. The heating process comprises a pre-heating stage, a heating stage and a soaking stage. The pre-heating stage satisfies the following formula (1). In the formula, VTp is a temperature increasing rate, in the pre-heating stage, whose unit is ° C./min; t is a total heating time of the slab in the heating furnace, and t=180-240 min; and Tc is an initial temperature when the slab is put into the furnace, whose unit is ° C. By using the foregoing formula, the heating process and the rough rolling process are changed, an occurrence rate of edge defects during the production of the hot rolled silicon steel can be reduced, and the hot rolled silicon steel with good surface quality can be produced.

$$V_{Tp} > \frac{220\ \text{min}}{t} \times \frac{100°\ \text{C.}}{T_C + 200°\ \text{C.}} \times 25°\ \text{C./min} \quad (1)$$

6 Claims, 3 Drawing Sheets

(51) Int. Cl.

| | |
|---|---|
| ***C21D 8/12*** | (2006.01) |
| ***C21D 1/26*** | (2006.01) |
| ***C22C 38/02*** | (2006.01) |
| ***H01F 41/00*** | (2006.01) |
| ***C21D 8/02*** | (2006.01) |
| ***C21D 8/04*** | (2006.01) |
| ***C21D 9/00*** | (2006.01) |
| ***C21D 9/70*** | (2006.01) |

(52) U.S. Cl.
CPC ..... *C21D 8/021* (2013.01); *C21D 8/041* (2013.01); *C21D 8/1205* (2013.01); *C21D 8/1216* (2013.01); *C21D 8/1244* (2013.01); *C21D 9/0081* (2013.01); *C21D 9/70* (2013.01); *C22C 38/02* (2013.01); *H01F 41/00* (2013.01); *C21D 2201/05* (2013.01)

(56) References Cited

FOREIGN PATENT DOCUMENTS

| | | |
|---|---|---|
| CN | 101947549 A | 1/2011 |
| JP | 61-243118 A | 10/1986 |

HOT ROLLED SILICON STEEL PRODUCING METHOD

CROSS REFERENCE TO RELATED APPLICATIONS

This application claims the priority benefit of PCT/CN2012/000401 filed on Mar. 29, 2012 and Chinese Application No. 201210065610.0 filed on Mar. 13, 2012. The contents of these applications are hereby incorporated by reference in their entirety.

TECHNICAL FIELD

The present invention relates to a manufacturing method of the hot rolled silicon steel, and specifically the method for improving the edge quality defect of silicon steel during the manufacture of the hot-rolled silicon steel.

BACKGROUND OF THE INVENTION

In the manufacturing process of the hot-rolled silicon steel, it's easy for various defects to occur in the course of rolling on the edges where stress is concentrated and temperature change is very dramatic, which thus influences the overall quality of the silicon steel, reduces the yield of products and further lowers the productivity effect. Specifically, the edge seam defect is one of the common edge defects of the hot-rolled silicon steel. Researches show that the edges and corners of the slab are always in a low temperature and high stress and strain status in the course of rolling; in the course of horizontal rolling, the inward frictional force of the roller on the rolled piece subjects the corner metal to the action of the intensive tensile stress, which finally flows to the upper surface of the rolled piece; with the progress of the post-horizontal rolling passes, the newly-formed boundaries push the original boundaries to move in a direction far away from the edges of the slab, and the intensive tensile stress status may induce the occurrence of the "black line" defect.

At present, there have been various reports on improving the said edge defects. For example, the patent literature 1 discloses a continuous casting crystallizer, on which the side wall of the short slab is designed into the circular arc shape and the four corners are designed into round corners, so as to achieve the side face of casting slab with circular arc round corners, prevent the occurrence of edges or corners flanging in the hot rolling process of the slab, avoid the rapid cooling of edges and corners and thus eliminate longitudinal linear black line and peeling-off defects. The patent literature 2 discloses a method by which the high surface quality of the silicon steel may be obtained through controlling the temperature gradients between the slab surface and a location at a certain depth of the silicon steel during the course of rough rolling and finishing rolling. Literature 3 adopts the grooved roll and the convex-type slab sizing press (SSP) module for the concave molding of the slab's side face to avoid the occurrence of defects, and has certain disadvantages: the grooved roll may easily cause serious scratches, and the convex-type SSP module may lead to unstable reduction and thus result in unstable rolling. Literatures 4 and 5 studied the basic flow rule of the metal in the edges and corners of the slab in the process of vertical-horizontal rolling process during rough rolling by the approach of numerical simulation calculation, and made a calculation with respect to the rule of the influence of various vertical roll shapes on the flow of the metal in the edges and corners of the rolled piece. However, the results of the research have not gone through production verification, and also belong to an improved method about reduction by the vertical roll during rough rolling. Literature 6 redesigns and modifies the vertical roll of the rough rolling mill to eliminate mechanical damages in the production process. Besides, in the production practice, the SSP module used has also been modified in some cases for the concave forming of the slab's side face, however, restrained by the unstable contact between the convex-type SSP module and the slab in the course of rolling, it leads to asymmetric metal flow on the two sides and makes it difficult to control the slab shape in subsequent rough rolling.

However, the literatures available so far are all concerned with the simulative calculation and actual improvement of the influence of the vertical roll and rolling piece shapes of rough rolling on the distance between a defect and the edges (edge distance). At present, there are no reports on eliminating and improving defects through changing the temperature of the rolled piece, particularly through changing the cross-sectional temperature of the rolled piece.

Existing technical literatures:

1. Chinese utility model patent ZL200720067413.7
2. U.S. Pat. No. 5,572,892A
3. YAMAGUCHI HARUO, KUSABA YOSHIAKI, YAMADA TAKEO, Techniques for the Control of Edge Crack Defects of Stainless Steel Sheets, Foreign Steel, 1996(12):48-52.
4. Xiong Shangwu, J. M. C. Rodrigues, P. A. F. Martins. Three-dimensional modelling of the vertical-horizontal rolling process [J], Finite Elements in Analysis and Design, 2003, 39:1023-1037.
5. Xiong Shangwu, Liu Xianghua, Wang Guodong, et al., Three-dimensional thermo-mechanical finite element simulation of the vertical-horizontal rolling process [J]. Journal of Materials Processing Technology, 2011, 11:89-97.
6. Gao Wenfang, Yan Zhengguo, Song Ping, Rao Kewei, Chen Fangwu, Kong Yongjiang, Research on the Linear Defects along the Edges of Shadow Mask and Chassis Cold-rolled Sheets [J], Steelmaking, 2003, 19(1).

SUMMARY OF THE INVENTION

In view of the above technical issues, the present inventor has conducted many tests repeatedly, from which it can be found that the occurrence rate of the edge defects of the silicon steel can be significantly reduced by changing the heating procedure in the manufacturing process of the hot-rolled silicon steel, and that such defect rate can be further reduced by changing the rough rolling procedure. Based on the said finding, the present inventor has completed the present invention.

To be specific, the aim of the present invention is to provide one manufacturing method of hot-rolled silicon steel, by which the edge defects of the silicon steel can be improved by changing the heating procedure and the rough rolling procedure, and the hot-rolled silicon steel with high surface quality can be manufactured as well.

To be specific, the technical scheme of the prevent invention is described below:

1. A manufacturing method of hot-rolled silicon steel, which comprises a heating procedure, a rough rolling procedure and a finishing rolling procedure on a silicon steel slab, where said heating procedure is conducted in a heating furnace comprising a preheating section, a heating section and a soaking section, wherein, the preheating section satisfies the following formula (1), $$V_{Tp} > \frac{220\ \text{min}}{t} \times \frac{100^\circ\ \text{C.}}{T_C + 200^\circ\ \text{C.}} \times 25^\circ\ \text{C./min} \quad (1)$$

wherein, $V_{Tp}$: Increasing rate of temperature of the preheating section, ° C./min, t: total heating time of the slab in the heating furnace, and t=180~240 min, $T_C$: initial temperature of the slab when entering into the furnace (° C.); the soaking section satisfies the following formula (2-1) or (2-2), $-10^\circ\ \text{C.} \leq T_S \leq 30^\circ\ \text{C.}$ (2-1), when the silicon content of the silicon steel is 1.5 wt % or above $10^\circ\ \text{C.} \leq T_S \leq 80^\circ\ \text{C.}$ (2-2), when the silicon content of the silicon steel is less than 1.5 wt % wherein, $T_S$: temperature rise of the soaking section, i.e., the difference between the temperature of the slab when entirely taken out of the furnace and its temperature at the end of the heating section ° C.; and the temperature rise of the heating section satisfies the following formula (3):

temperature rise of the heating section=(temperature of the slab when entirely taken out of the furnace−temperature rise of the soaking section)−temperature at the end of the preheating section (3)

wherein said preheating section refers to a section from an entering point at which the slab enters into the furnace to a point that is 1/6~1/3 of the furnace length away from said entering point, said soaking section refers to a section from an exit point at which the slab is taken out of the furnace to a point that is 1/6~1/3 of the furnace length away from said exit point, and said heating section refers to a section that is between the preheating section and the soaking section.

2. The manufacturing method of a hot-rolled silicon steel according to (1), wherein 1 to 6 passes of said reduction by vertical rolling is/are applied in said rough rolling procedure.

3. The manufacturing method of a hot-rolled silicon steel according to (2), wherein a reduction for each side reduction by vertical rolling is 10~40 cm.

4. The manufacturing method of a hot-rolled silicon steel according to (2), wherein 3 to 8 passes of horizontal reduction are applied in the rough rolling, with an accumulated reduction rate of 70~90%.

5. The manufacturing method of a hot-rolled silicon steel according to (2), wherein a time period from the point just after the slab is entirely taken out of the furnace to the point when the final pass of the rough rolling is completed does not exceed 360 seconds.

6. The manufacturing method of a hot-rolled silicon steel according to (2), wherein a slab sizing press is used in the rough rolling procedure, with a side reduction ranging from 10 to 180 cm.

Effect of the Present Invention

The manufacturing method of a hot-rolled silicon steel according to the present invention can be applied to reduce the occurrence rate of the edge defects of the silicon steel in the manufacturing process, and thus manufacture the hot-rolled silicon steel with high surface quality.

BRIEF DESCRIPTION OF THE DRAWINGS

(FIG. 4 is the online detection photo, and FIG. 5 is the physical photo).

DETAILED DESCRIPTION OF THE INVENTION

The manufacturing method of the hot-rolled silicon steel mainly includes the heating procedure, rough rolling procedure and finishing rolling procedure of the silicon steel slab, and may further include the coiling procedure as needed, by which the hot-rolled silicon steel can be coiled into silicon steel coils, i.e. hot-rolled silicon steel coils.

Figure 1:
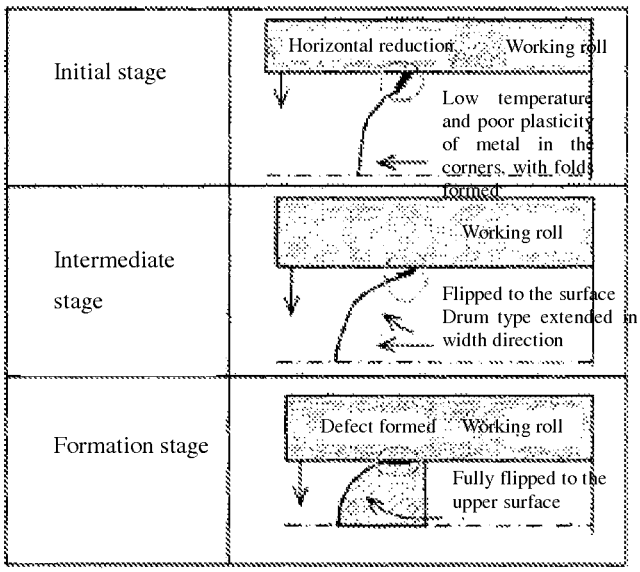
FIG. 1 shows the rule of metal flow of the edges and corners of the slab in the rough rolling.

The present inventor has conducted temperature measurement, observation and simulative calculation based on the practical production and reached a conclusion. As far as the hot-rolled silicon steel is concerned, edge defects are caused mainly because, in the horizontal rolling and vertical rolling of the rough rolling, the upper and lower edges on the side face of the slab are respectively flipped to the upper and lower surfaces (as shown in FIG. 1). For various steel types, there are four possible formation mechanisms after the edges are flipped to the surface.

Cause (1)

For steel types having a low thermal conductivity and poor plasticity: most significantly affected by air cooling, the edges of the slab have the minimum temperature and formed defects after being rolled and flipped to the surface of the silicon steel. Due to the low temperature of the edges, they are inconsistent with their surrounding structures in deformation resistance and thus lead to cracks in the rolling extension, and defects are formed along the rolling direction in the subsequent rolling due to the failure for welding.

Cause (2)

For steel types having a relatively high γ-α phase change temperature: the metal of the edges of the slab is in the two-phase zone in the rough rolling, and given that the deformation stress of ferrite is ¼ lower than that of austenite phase and that deformation is concentrated in the ferrite phase, it may easily increase local deformation in the subsequent rolling process and lead to the final fracture thereby forming defects of the ferrite phase.

Cause (3)

For steel types susceptible to overburning: the defects caused by overburning on the edges and side face of the slab are left on the surface edges of the steel sheet, resulting in edge seam defect.

Cause (4)

Steel types which are difficult to remove their iron skin: the oxide layer on the edges of the slab is difficult to be removed and left on the surface edges of the steel sheet, resulting in edge seam defect.

In the present invention, the improvement of the edge quality of the hot-rolled silicon steel only involves the heating procedure and rough rolling procedure and has no special limitation on the finishing rolling procedure, and the finishing rolling procedure in the present manufacturing method of the hot-rolled silicon steel may be adopted.

A detailed explanation is provided below of various procedures involved in the present invention.

1 Heating Procedure

The heating procedure is conducted in the heating furnace and has no special limitation on the heating furnace; the walking beam heating furnace commonly used in the manufacturing method of the hot-rolled silicon steel may be adopted; the nozzle type may be conventional nozzle or regenerative nozzle.

The heating furnace of the hot-rolled silicon steel is generally divided into preheating section, heating section and soaking section. However, for some new-type hot rolling heating furnace, such strict division as above is not adopted (like pulse-type heating furnace), and the said various sections of the present invention are defined on the basis of the following principles:

wherein said preheating section refers to a section from an entering point at which the slab enters into the furnace to a point that is 1/6~1/3 of the furnace length away from said entering point;

said soaking section refers to a section from an exit point at which the slab is taken out of the furnace to a point that is 1/6~1/3 of the furnace length away from said entering point;

said heating section refers to a section that is between the preheating section and the soaking section.

The heating characteristics of the existing heating system lies in that the preheating section has a relatively lower temperature while the heating section has a relatively higher temperature, and that the temperature of the soaking section is equivalent to the tapping temperature, so that the heat absorbed by the slab in the heating section will continuously conducted to the core to achieve the object of uniform distribution of the cross-sectional temperature of the slab. However, the specific type of silicon steel manufactured by such heating system has a very high occurrence rate of edge seam defect, and exceeding to 80% in some cases, in which case edge cutting is needed to eliminate such defects.

In the present invention, the following requirements are imposed on the heating procedure:

(1) Improving the Temperature of the Soaking Section

Figure 2:
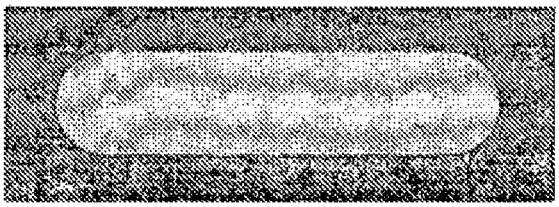
FIG. 2 shows the sectional temperature distribution of the casting slab obtained by the heating procedure of the present invention.

The aim is to achieve the cross-sectional temperature distribution of the slab as shown in FIG. 2, i.e., achieving a relatively high surface temperature of the slab, particularly achieving a relatively high edge temperature of the slab, with the following three specific purposes:

① Eliminating the defects caused by the above cause (1): The relatively high edge temperature of the slab improved its molding in the rough rolling, reduced the difference between the flipped edges and their surrounding structures, and lowered the degree of defects or avoided the occurrence of defects.

② Eliminating the defects caused by the above cause (2): Given that the edges of the slab have achieved a relatively high temperature in the heating process, which is higher than the phase change point in the rough rolling process (or the phase change occur until the final pass of the rough rolling), the defects caused by phase change have been avoided.

Figure 3:
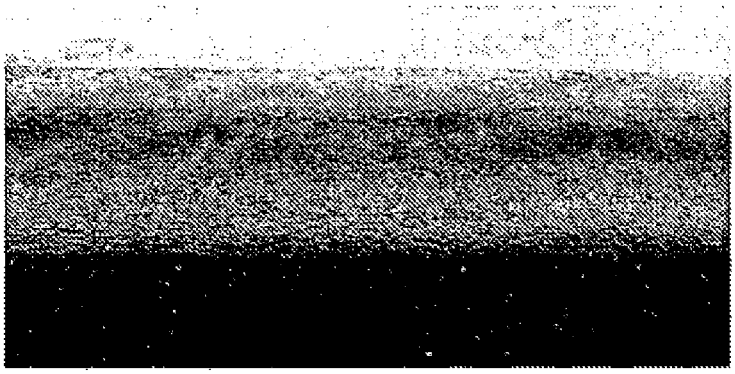
FIG. 3 shows the intermediate slab with a concave side face obtained after the rough rolling by the heating method of the present invention.
Figure 4:
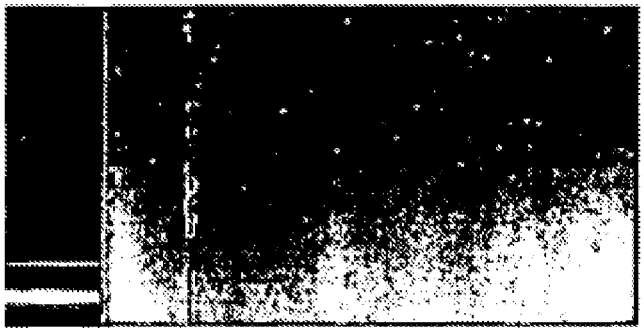
FIG. 4 and FIG. 5 show the photos of the edge seam defect of the hot-rolled silicon steel
Figure 5:
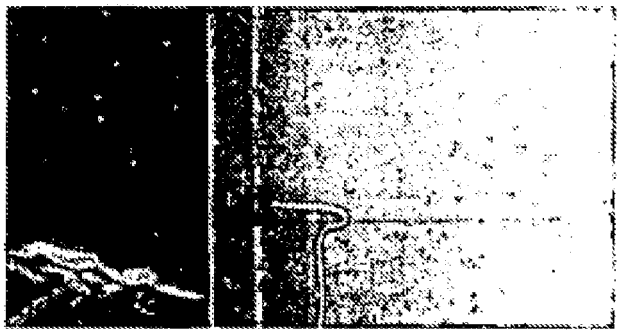
Figure 6:
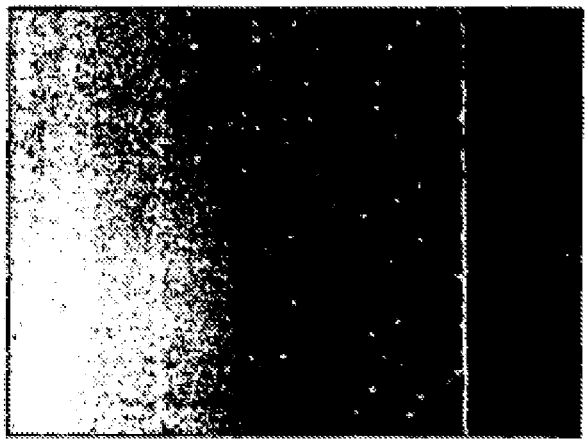
FIG. 6 shows the photo of the edges of the silicon steel manufactured by the heating method of the present invention.
Figure 7:
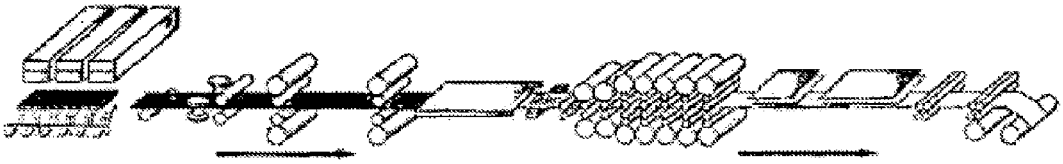
FIG. 7 shows the schematic diagram of the manufacturing process of the hot-rolled silicon steel.

③ Reducing the distance between the defects and the edges due to high surface horizontal extension during the rough rolling: The upper and lower surfaces have a relatively lower deformation resistance due to the high temperature, and thereby a relatively high extension during the rolling and reduced the edge distance from the flipped edges to the surface. The results have been verified by the actual production, and FIG. 3 shows the intermediate slab with a concave side face obtained after the rough rolling through the adjustment of the heating process.

Thus, in the present invention, the soaking section satisfies the following formula (2-1) or (2-2), $-10° C. \leq T_S \leq 30° C.$ (2-1), when the silicon content of the silicon steel is 1.5 wt % or above, $10° C. \leq T_S \leq 80° C.$ (2-2), when the silicon content of the silicon steel is less than 1.5 wt %, wherein, $T_S$: Temperature rise of the soaking section, i.e., the difference between the temperature of the slab when entirely taken out of the furnace and its temperature at the end of the heating section, ° C.; and By improving the temperature of the soaking section, the defects caused by the above cause (1) and cause (2) may be eliminated.

(2) Increasing the Temperature of the Preheating Section

In the present invention, it's necessary to increase the temperature of the preheating section because temperature is reduced in the subsequent heating section; thus, in order to maintain the same production pace without increasing the retention time of the slab in the furnace, the heating temperature of other sections must be increased to offset the influence of the reduced temperature of the heating section on heat absorption by the slab.

Thus, the preheating section satisfies the following formula (1), $$V_{Tp} > \frac{220 \text{ min}}{t} \times \frac{100° \text{ C.}}{T_C + 200° \text{ C.}} \times 25° \text{ C./min} \quad (1)$$

wherein, $V_{Tp}$: Increasing rate of temperature of the preheating section, ° C./min, t: Total heating time of the slab in the heating furnace, and t=180~240 min, $T_C$: Initial temperature of the slab when entering into the furnace, ° C.;

(3) Reducing the Temperature of the Heating Section

Reducing the temperature of the heating section can prevent the overburning of the edges of the slab and avoid the linear defect caused by the above cause (3); meanwhile, given that the oxidation process is accelerated at a high heating temperature and that the ingredients of the oxides are also changed due to the rise of temperature, a layered iron skin may easily be formed and difficult to be removed when the slab is taken out of the furnace; thus, reducing the temperature of the heating section may also avoid the edge seam defect caused by the above cause (4).

However, as a matter of fact, in view of the differences in the retention time in the furnace and the temperature when the slab is taken out of the furnace in the heating section, no specific requirement is imposed on the temperature of the furnace gas, and it may be determined on the basis of the temperature of the preheating section and the temperature rise of the soaking section.

Given that the technique has limitations on the heating method of the preheating section and the soaking section, the temperature of heating section is determined by the actual production. To be specific, the temperature rise of the slab in the heating section satisfies the following formula (3):

Temperature rise of the slab in the heating section= (Temperature of the slab when taken out of the furnace−Temperature rise of the soaking section)−Temperature at the end of the preheating section (3)

wherein, said temperature of the slab when taken out of the furnace refers to the temperature of the slab when it is just taken out of the furnace entirely, i.e., the target heating temperature of the slab;

said temperature rise of the soaking section, as mentioned above, refers to the difference between the temperature of the slab when entirely taken out of the furnace and its temperature at the end of the heating section (° C.);

said temperature at the end of the preheating section refers to the temperature of the slab when it is entirely taken out of the preheating section.

The temperature of the furnace gas in the heating section is determined on the basis of the temperature rise of the heating section as calculated above in combination with the actual production pace (moving forward rate of the slab inside the furnace).

2 Rough Rolling Procedure

In the present invention, various terms in the rough rolling procedure are defined below:

Side reduction refers to the actual width reduction caused by the deformation force received by the slab in the width direction. The deformation force here may come from the vertical roll or from the slab sizing press.

Side reduction by vertical rolling refers to the actual reduction of the slab by the vertical roll, i.e., width reduction of the slab after going through the vertical roll.

Individual reduction refers to the width reduction of the slab after going through the vertical roll each time.

Horizontal reduction refers to the deformation of the slab caused by the pressure imposed by the horizontal roller.

Accumulated reduction rate refers to the ratio (%) of the outlet thickness of the slab at the end of rolling to its inlet thickness at the beginning of rolling.

SSP side reduction refers to the width reduction of the slab after reduction by SSP.

In the present invention, the rough rolling equipment commonly used in the existing manufacturing method of the hot-rolled silicon steel may be adopted in the rough rolling procedure. The two-roller rolling mill or four-roller rolling mill may be adopted as the rough rolling equipment.

As for the setting of various parameters of the rough rolling procedure, the parameters commonly applied at present may be used as a reference. However, if some parameters of the rough rolling procedure are set as provided below, the occurrence rate of edge defects of the hot-rolled silicon steel may be further reduced.

(1) Side Reduction

In the present invention, 1~6 passes of side reduction by vertical rolling is/are applied, wherein a reduction for each side reduction is 10~40 cm; preferably three passes of side reduction by vertical rolling are applied, with the individual reduction amounting to 30 cm;

(2) Horizontal Reduction

In the present invention, 3~8 passes of horizontal roller reduction are applied, with an accumulated reduction rate of 7~90%.

(3) Descaling Water

In order to prevent excessive decline of surface temperature, the number of passes of water used in the rough rolling zone is controlled below 4 from taking out of the slab from the heating furnace to the intermediate roller bed.

(4) Rough Rolling Time

In order to prevent excessive decline of surface temperature, the rough rolling should proceed quickly, and the period between the time when the entire slab is just taken out of the furnace and the time when the final pass of the rough rolling is completed is controlled within 360 s.

(5) Slab Sizing Press (SSP)

SSP may be used in the rough rolling procedure as needed. Using the SSP module with a concave outline helps to reduce the distance from the edge defects to the edges; thus, the amount of edge cutting in the subsequent procedure may be reduced to increase the yield. If SSP is used, its side reduction is required to be controlled within the range of 10~180 cm.

3 Finishing Rolling Procedure

In the manufacturing method of the hot-rolled silicon steel of the present invention, improving the edge quality of the hot-rolled silicon steel does not involve the improvement of the finishing rolling procedure, so it has no special limitation on the finishing rolling procedure, and the finishing rolling equipment commonly used in the manufacturing method of the hot-rolled silicon steel at present may be adopted, i.e., generally 5~7-rack four-roller rolling mill.

4 Coiling Procedure

The hot-rolled silicon steel of the present invention can be coiled into hot-rolled silicon steel coils as needed, i.e. silicon steel coils.

EXAMPLES

Next, the technical scheme of the present invention will be further described in combination with examples and comparative examples, but the present invention is not limited to these examples.

The raw materials and equipment used in the production process are described below:

Slab materials: The silicon steel slabs of various silicon contents manufactured by Baoshan Iron & Steel Co., Ltd., or similar products sold on the market, may be used in the present invention.

Heating furnace: Walking beam heating furnace, with a regenerative nozzle.

Slab sizing press (SSP): A sizing press with inlet side guide plate, outlet/inlet pinch roller and pressure roller.

Rough rolling equipment: Double racks, the first of which is a two-roller rolling mill without the vertical roll, while the second of which is a four-roller rolling mill capable of reverse rolling and including the vertical roll.

Finishing rolling equipment: Seven-rack four-roller rolling mill.

Examples 1~5

The silicon steel slab A (with a silicon content of 2.1% by weight) successively goes through the following procedures to manufacture the hot-rolled silicon steel.

(1) Heating Procedure

Based on the heating conditions provided in Table 1, the slabs in the Examples 1~5 respectively enters into the heating furnace to successively go through the three-section heating procedure (i.e., preheating section, heating section and soaking section) before taken out of the furnace.

(2) Rough Rolling Procedure

As shown in Table 1, set the side reduction, the horizontal reduction, the number of passes of water used in the rough rolling zone in the descaling water step and the rough rolling time, and send the silicon steel slabs after the heating procedure into the rough rolling equipment for rough rolling.

The Example 5 uses the slab sizing press, which is not used in the Examples 1~4.

(3) Finishing Rolling Procedure

Send the slabs after rough rolling into the finishing rolling equipment for finishing rolling.

The parameters should be set as follows:

Threading speed: 9~11 m/s; target thickness: 2.0~2.6 mm.

After that, respectively evaluate the occurrence rate of edge defects of various hot-rolled silicon steel products.

Using the surface quality detector of strip steel to take full-coverage photos of the total-length range of the upper and lower surface of the hot-rolled silicon steel, and then manually inspecting the surface quality on four locations on the upper, lower surfaces and both sides of the hot-rolled silicon steel; taking a distance of 15 mm away from the edges as the standard; when there is a continuous 5 meters defects or there are more than ten edge seam defect within the above range, the hot-rolled silicon steel is then determined as unqualified. Multiple coils of strip steel are produced in the test, then:

Defect occurrence rate=Amount of unqualified silicon steel/Amount of produced silicon steel coils×%

TABLE 1

| | | | Examples | | | | |
|---|---|---|---|---|---|---|---|
| | | | 1 | 2 | 3 | 4 | 5 |
| Temperature of the entire slab when entering into the furnace | | | 288 | 268 | 285 | 272 | 283 |
| Heating procedure | Preheating section | Increasing rate of temperature $V_{Tp}$ (° C./min) | 8 | 5 | 5 | 8 | 8 |
| | Heating section | Temperature rise (° C.) | 310 | 466 | 499 | 294 | 311 |
| | Soaking section | Temperature rise (° C.) | 10 | 10 | −10 | 30 | 10 |
| | Total retention time of the slab in the heating furnace (min) | | 221 | 218 | 215 | 217 | 218 |
| Temperature of the entire slab upon being taken out of the furnace (° C.) | | | 1120 | 1120 | 1120 | 1120 | 1120 |
| Rough rolling procedure | Individual reduction (cm) | | 10 | 20 | 40 | 20 | 30 |
| | Side reduction by vertical rolling (pass(es)) | | 1 | 3 | 4 | 6 | 3 |
| | Rough rolling time (s) | | 210 | 210 | 210 | 200 | 200 |
| | SSP | | — | — | — | — | Yes |
| Evaluation | Occurrence rate of edge defects | | 0.5% | 2.2% | 3.0% | 1.8% | 2.0% |

It can be known from Table 1 that, in the Examples 1~5 in which both the heating procedure and rough rolling procedure have followed the manufacturing method of the present invention, the occurrence rate of edge defects are all controlled below 3.0%.

Examples 6~10

The silicon steel slab A (with a silicon content of 2.1% by weight) used in the Examples 1~5 is also used in the examples 6~10, and except that the rough rolling procedure is conducted as provided in Table 2, all the procedures adopted for manufacturing the silicon steel are the same as those adopted in the Examples 1~5.

The same evaluation method as that adopted in the Examples 1~5 is adopted to evaluate the occurrence rate of edge defects of the silicon steel in the Examples 6~10.

TABLE 2

| | | Examples | | | | |
|---|---|---|---|---|---|---|
| | | 6 | 7 | 8 | 9 | 10 |
| Rough rolling procedure | Individual reduction (cm) | 0 | 0 | 50 | 50 | 50 |
| | Side reduction by vertical rolling (pass(es)) | 3 | 3 | 3 | 3 | 3 |
| | Rough rolling time (s) | 200 | 290 | 200 | 290 | 200 |
| | SSP | — | — | — | — | Yes |

TABLE 2-continued

| | | Examples | | | | |
|---|---|---|---|---|---|---|
| | | 6 | 7 | 8 | 9 | 10 |
| Evaluation | Occurrence rate of edge defects | 3.6% | 4.7% | 4.1% | 5.0% | 3.5% |

It can be known from Table 2 that, in the Examples 6~10 in which the heating procedure employs the method of the present invention while the rough rolling procedure still adopts the existing techniques to manufacture the silicon steel, the occurrence rate of edge defects range between 3.5% and 5%, slightly higher than those in the Examples 1~5 in which both the heating procedure and rough rolling procedure have followed the manufacturing method of the present invention.

Examples 11~15

The silicon steel slab B (with a silicon content of 0.5% by weight) is used in the Examples 11~15, and except that the heating procedure is conducted as provided in Table 3, all the procedures adopted for manufacturing the silicon steel are the same as those adopted in the Examples 1~5, and the same evaluation method as that adopted in the Examples 1~5 is adopted to evaluate the occurrence rate of edge defects in the Examples 11~15.

TABLE 3

| | | | Examples | | | | |
|---|---|---|---|---|---|---|---|
| | | | 11 | 12 | 13 | 14 | 15 |
| Heating procedure | Preheating section | Increasing rate of temperature $V_{Tp}$ (° C./min) | 5 | 5 | 5 | 5 | 5 |
| | Heating section | Temperature rise (° C.) | 480 | 461 | 433 | 391 | 362 |
| | Soaking section | Temperature rise (° C.) | −10 | 10 | 40 | 80 | 100 |
| Total retention time of the slab in the furnace (min) | | | 215 | 216 | 213 | 211 | 213 |
| Evaluation | Occurrence rate of edge defects | | 1.8% | 1.1% | 0.5% | 1.2% | 2.2% |

It can be known from Table 3 that, for the silicon steel slab with a silicon content of 0.5% by weight, the heating method and rough rolling method of the present invention can also be applied to control the occurrence rate of edge defects at a relatively low level.

Comparative Examples 1~5

The Comparative Examples 1~3 adopt the silicon steel slab A (with a silicon content of 2.1% by weight), and the comparative Examples 4~5 adopt the silicon steel slab B (with a silicon content of 0.5% by weight); the comparative Examples 1~5 respectively conduct their heating procedure and rough rolling procedure based on the parameters provided in Table 4, and other than that, they adopt the same procedures as those adopted in the Examples 1~5 to manufacture the silicon steel and employ the same evaluation method as that adopted in the Examples 1~5 to evaluate the occurrence rate of edge defects.

TABLE 4

| | | | Comparative examples | | | | |
|---|---|---|---|---|---|---|---|
| | | | 1 | 2 | 3 | 4 | 5 |
| Silicon content of the silicon steel slab (wt %) | | | 2.1 | 2.1 | 2.1 | 0.5 | 0.5 |
| Temperature of the entire slab upon entering into the furnace (° C.) | | | 281 | 277 | 275 | 270 | 263 |
| Heating procedure | Preheating section | Increasing rate of temperature $V_{Tp}$ (° C./min) | 3 | 3 | 3 | 3 | 3 |
| | Heating section | Temperature rise (° C.) | 471 | 470 | 475 | 570 | 457 |
| | Soaking section | Temperature rise (° C.) | 80 | 80 | 80 | −20 | 100 |
| Total retention time of the slab in the furnace (min) | | | 191 | 193 | 188 | 183 | 181 |
| Temperature of the entire slab upon being taken out of the furnace (° C.) | | | 1120 | 1120 | 1120 | 1120 | 1120 |
| Rough rolling procedure | Individual reduction (cm) | | 50 | 7 | 50 | 50 | 50 |
| | Side reduction by vertical rolling (pass(es)) | | 3 | 3 | 3 | 3 | 3 |
| | Rough rolling time (s) | | 240 | 240 | 200 | 200 | 200 |
| | SSP | | — | — | — | — | Yes |
| Evaluation | Occurrence rate of edge defects | | 11% | 8% | 7% | 8% | 6% |

It can be known from Table 4 that, the occurrence rate of edge defects of the hot-rolled silicon steel products manufactured by the present manufacturing methods, i.e., the Comparative Examples 1~5, are respectively 11%, 8%, 7%, 8% and 6%, which are obviously higher than the occurrence rate of edge defects of the hot-rolled silicon steel products in the Examples 1~15 of the present invention.

As can be known from the above Examples 1~15 and Comparative Examples 1~5, when manufacturing the hot-rolled silicon steel, the heating procedure of the present invention can obviously reduce the occurrence rate of edge defects, and simultaneously adopting the heating procedure and rough rolling procedure of the present invention can further reduce the occurrence rate of edge defects.

Thus, the ideal choice is adopt the heating procedure and rough rolling procedure of the present invention simultaneously.

Industrial applicability—The manufacturing method of the present invention can effectively reduce the occurrence rate of edge defects of the hot-rolled silicon steel and produce the hot-rolled silicon steel with a high surface quality, so it can be extensively applied in the manufacture of hot-rolled silicon steel coils.

The invention claimed is:

1. A manufacturing method of a hot-rolled silicon steel comprising a heating procedure, a rough rolling procedure, and a finishing rolling procedure on a silicon steel slab, where said heating procedure is conducted in a heating furnace comprising a preheating section, a heating section and a soaking section, wherein, the preheating section satisfies the following formula (1), $$V_{Tp} > \frac{220\ \text{min}}{t} \times \frac{100^\circ\ \text{C.}}{T_C + 200^\circ\ \text{C.}} \times 25^\circ\ \text{C./min} \quad (1)$$

wherein, $V_{Tp}$: Increasing rate of temperature of the preheating section, ° C./min, t: Total heating time of the slab in the heating furnace, and t=180~240 min, $T_C$: Initial temperature of the slab when entering into the furnace, ° C.;

the soaking section satisfies the following formula (2-1) or (2-2), $-10^\circ\ \text{C.} \leq T_S \leq 30^\circ\ \text{C.}$ (2-1), when the silicon content of the silicon steel is 1.5 wt % or above, $10^\circ\ \text{C.} \leq T_S \leq 80^\circ\ \text{C.}$ (2-2), when the silicon content of the silicon steel is less than 1.5 wt %, wherein, $T_S$: Temperature rise of the soaking section, i.e., the difference between the temperature of the slab when entirely taken out of the furnace and its temperature at the end of the heating section, ° C.; and the temperature rise of the heating section satisfies the following formula (3):

temperature rise of the heating section=(temperature of the slab when entirely taken out of the furnace−temperature rise of the soaking section)−temperature at the end of the preheating section (3), wherein said preheating section refers to a section from an entering point at which the slab enters into the furnace to a point that is 1/6~1/3 of the furnace length away from said entering point, said soaking section refers to a section from an exit point at which the slab is taken out of the furnace to a point that is 1/6~1/3 of the furnace length away from said exit point, and said heating section refers to a section that is between the preheating section and the soaking section.

2. The manufacturing method of claim 1, wherein 1 to 6 passes of side reduction by vertical rolling is applied in said rough rolling procedure.

3. The manufacturing method of claim 2, wherein a reduction for each side reduction by vertical rolling is 10~40 cm.

4. The manufacturing method of claim 2, wherein 3 to 8 passes of horizontal reduction are applied in the rough rolling, with an accumulated reduction rate of 70~90%.

5. The manufacturing method of claim 2, wherein a time period from the point just after the slab is entirely taken out of the furnace to the point when the final pass of the rough rolling is completed and does not exceed 360 seconds.

6. The manufacturing method of claim 2, wherein a slab sizing press is used in the rough rolling procedure with a side reduction ranging from 10 to 180 cm.

* * * * *